US012808211B2

(12) United States Patent
Sanchez Garduño et al.

(10) Patent No.: US 12,808,211 B2
(45) Date of Patent: Nov. 24, 2026

(54) PLUG FOR CLOSING HOLES IN CONCRETE WALLS

(71) Applicants: 20EMMA20 S.L., Aduna (ES); HEGAIN 2100 Consulting S.L., Irun (ES)

(72) Inventors: Javier Sanchez Garduño, Irun (ES); Juan Andrés Elduayen Madariaga, Aduna (ES)

(73) Assignee: RIVESTOP SYSTEMS, S.L., Andoain (ES)

( * ) Notice: Subject to any disclaimer, the term of this patent is extended or adjusted under 35 U.S.C. 154(b) by 181 days.

(21) Appl. No.: 18/931,765

(22) Filed: Oct. 30, 2024

(65) Prior Publication Data

US 2025/0052078 A1 Feb. 13, 2025

Related U.S. Application Data

(63) Continuation of application No. PCT/EP2023/062835, filed on May 12, 2023.

(30) Foreign Application Priority Data

May 16, 2022 (EP) ..... 22382469

(51) Int. Cl.
*E04G 17/06* (2006.01)

(52) U.S. Cl.
CPC ..... *E04G 17/0644* (2013.01)

(58) Field of Classification Search
CPC ..... E04G 17/0644; E04G 17/007; E04G 23/0207; E04G 23/0203; E04B 1/41; F16B 13/04
See application file for complete search history.

(56) References Cited

U.S. PATENT DOCUMENTS 2,390,929 A * 12/1945 Ellis ..... E04B 1/41 411/456
3,827,208 A 8/1974 Elliott
2014/0353325 A1* 12/2014 LaBruzza ..... E04G 17/0644 220/796

FOREIGN PATENT DOCUMENTS

DE 202006005621 U1 8/2006
DE 202008015694 U1 4/2009
DE 202017102732 U1 9/2018
EP 2407611 A1 * 1/2012 ..... E04G 17/0644
GB 2618608 A * 11/2023 ..... E04G 23/0203
WO WO-2017126449 A1 * 7/2017 ..... F16B 5/06

OTHER PUBLICATIONS

International Search Report and the Written Opinion, PCT/EP2023/062835, Jul. 12, 2023, 11 pages.
European Search Report, EP22382469, Oct. 31, 2022, 7 pages.

* cited by examiner

*Primary Examiner* — Patrick J Maestri
(74) *Attorney, Agent, or Firm* — Edell, Shapiro & Finnan, LLC

(57) ABSTRACT

A plug for closing a hole in a concrete wall. The plug includes a main body and elastic retention means. The retention means includes at least one hook partially embedded in the main body and partially projecting from the main body, the at least one hook being configured for cooperating with the hole in the concrete wall for retaining the plug in the hole.

20 Claims, 16 Drawing Sheets

PLUG FOR CLOSING HOLES IN CONCRETE WALLS

CROSS-REFERENCE TO RELATED APPLICATIONS

This application relates to and claims the benefit and priority to International Application NO. PCT/EP2023/062835, filed May 12, 2023, which relates to and claims the benefit and priority to European Application No. EP22382469.9, filed May 16, 2022, each of which is incorporated by reference herein in its entirety.

FIELD

The present invention relates to closing plugs for covering and concealing holes in concrete walls, said holes preferably being made by the formwork anchoring system.

BACKGROUND

Closing plugs for covering and concealing holes in concrete walls and the like are known. Said holes are usually made by the manufacturing process of said concrete walls.

Concrete walls are manufactured on site, providing a gap between two formwork panels that are arranged in such a way that they face each other. These panels are secured together by means of an anchoring system comprising transverse bolts the ends of which are threaded. Said threaded ends protrude from the formwork panels so that the corresponding nuts can be threaded, thus securing the formwork panels.

Once the panels are secured, concrete is poured into the gap which is sandwiched between the formwork panels. For the concrete not to adhere to the transverse bolts once it has set, said bolts are previously lined by placing them in a tube, preferably made of plastic, and cones or frustoconical elements, also made of plastic, are placed at the ends to facilitate supporting against the formwork. Once the concrete has set, the formwork panels, transverse bolts, and cones or frustoconical elements are disassembled. The removal of the protective tube is optional, but since this operation is fairly tedious, many times said tubes are not disassembled and remain inside the wall.

Upon disassembling the anchoring system of the formwork panels, i.e., upon disassembling the transverse bolts and cones or frustoconical elements, through holes are generated in the concrete wall. To conceal said holes, closing plugs, preferably having a frustoconical shape, are placed in said holes, which plugs are secured in the wall by means of applying an adhesive. Other means for securing said plugs are also known.

In this sense, DE202006005621U1 describes a decorative plug for concealing a hole in a concrete wall, which hole is generated by the manufacturing process of said wall. Said plug comprises a main body made of plastic and elastic retention means, also made of plastic, which retain the plug in place inside the protective plastic tube of the hole in the concrete wall. The plug comprises a frustoconical head and a cylindrical appendage extending from said head. A decorative metallic disc is fixed at the end of the head by means of adhesive. The elastic means comprise in one embodiment a plurality of elongated ribs arranged on the appendage such that they radially protrude.

DE202008015694U1 describes a plug for closing a hole in a concrete wall, comprising a main body and conically tapering retention means. The retention means comprise a sleeve shaped body, which is partially embedded in the main body, and three hooks projecting from the sleeve shaped body, the plug being retained inside the hole by the hooks.

SUMMARY

Disclosed are plugs for closing and concealing a hole in a concrete wall.

The plug comprises a main body and elastic retention means, said retention means comprising at least one hook partially embedded in the main body and partially projecting from the main body. The at least one hook is configured for cooperating with the hole in the concrete wall for retaining the plug in said hole.

Placing said plug in the hole in the concrete wall is facilitated with the plug because it is not necessary to use additional means, such as adhesives, for example, to retain the plug in place. Furthermore, the securing of said plug is also improved because the hook of the elastic means provides good securing whether the hole to be plugged comprises the protective plastic tube of the transverse bolts (securing on a plastic material) or does not comprise said tube (securing directly on the concrete).

These and other advantages and features will become apparent in view of the figures and detailed description.

DETAILED DESCRIPTION

Figure 1A:
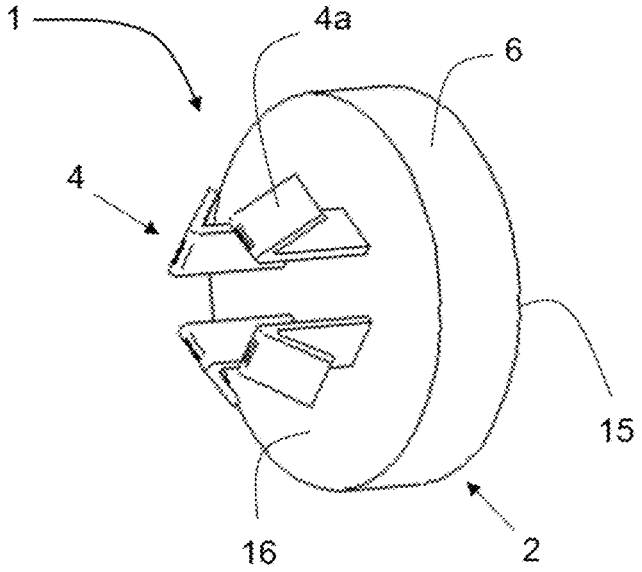
FIG. 1A shows a perspective view of a plug according to a first embodiment.
Figure 1B:
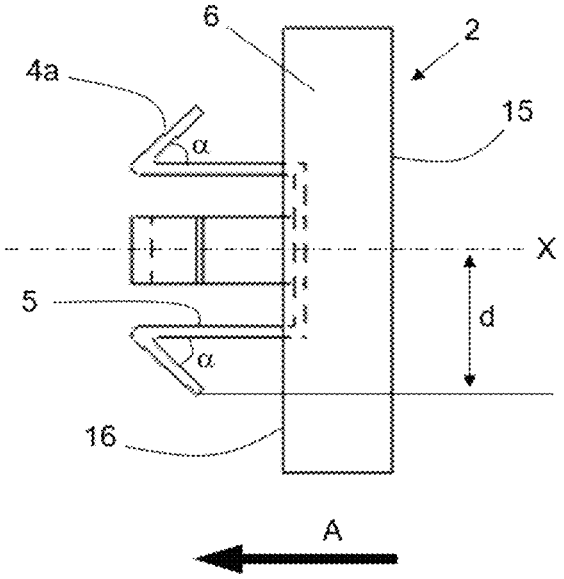
FIG. 1B shows a side view of the plug of FIG. 1A.

FIGS. 1A and 1B show a first embodiment of the plug 1 according to the invention. As shown in said figures, the plug 1 comprises a main body 2 and elastic retention means 4. According to the invention, the retention means 4 comprise at least one hook partially embedded in the main body 2 and partially projecting from the main body 2. The at least one hook is configured for cooperating with the hole 8 in the concrete wall 9 for retaining the plug 1 in place inside said hole 8. The retention means 4 can also comprise a plurality of hooks protruding at least partially from the main body 2. In the non-limiting example of FIGS. 1A and 1B, for example, the retention means 4 comprise four hooks arranged as will be described in detail below.

Figure 11A:
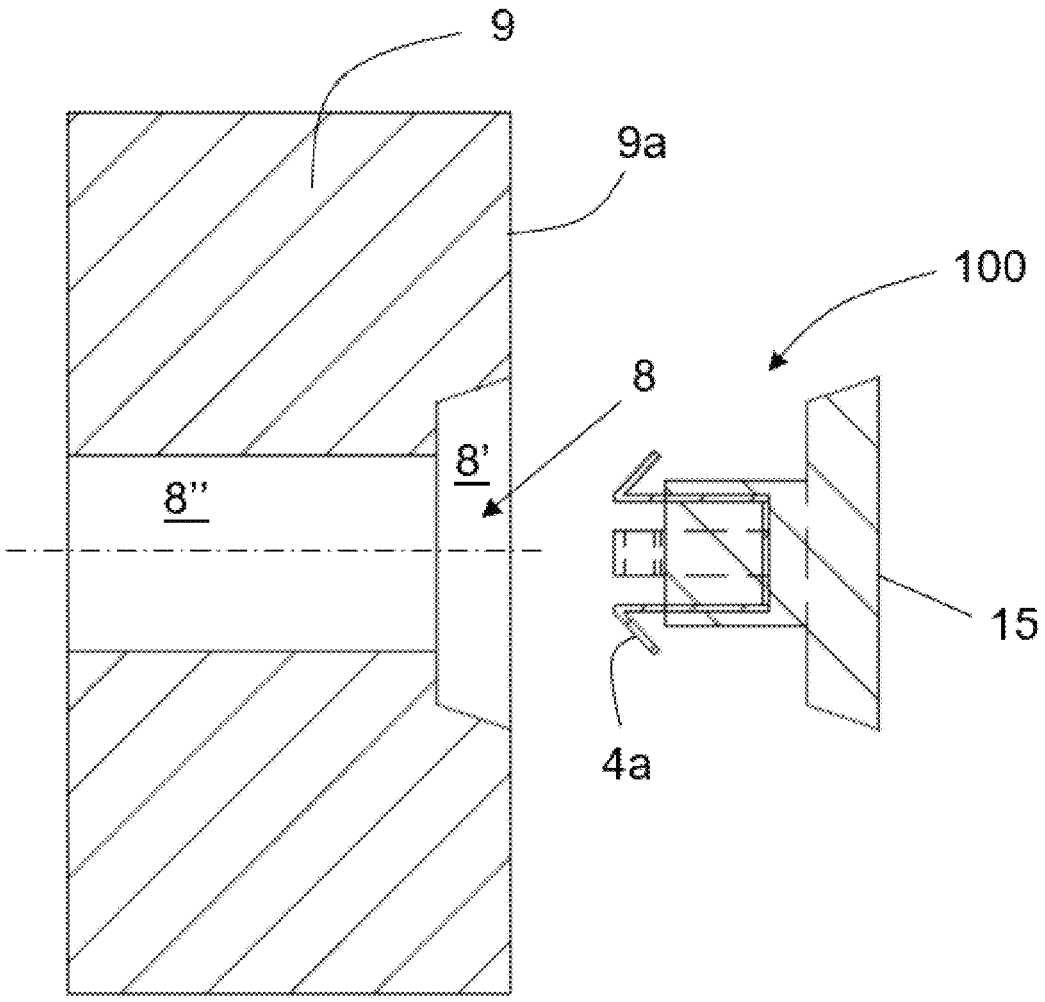
FIG. 11A shows a section view of the concrete wall with a hole and the plug of FIG. 3A before being introduced in the hole to be plugged.
Figure 11B:
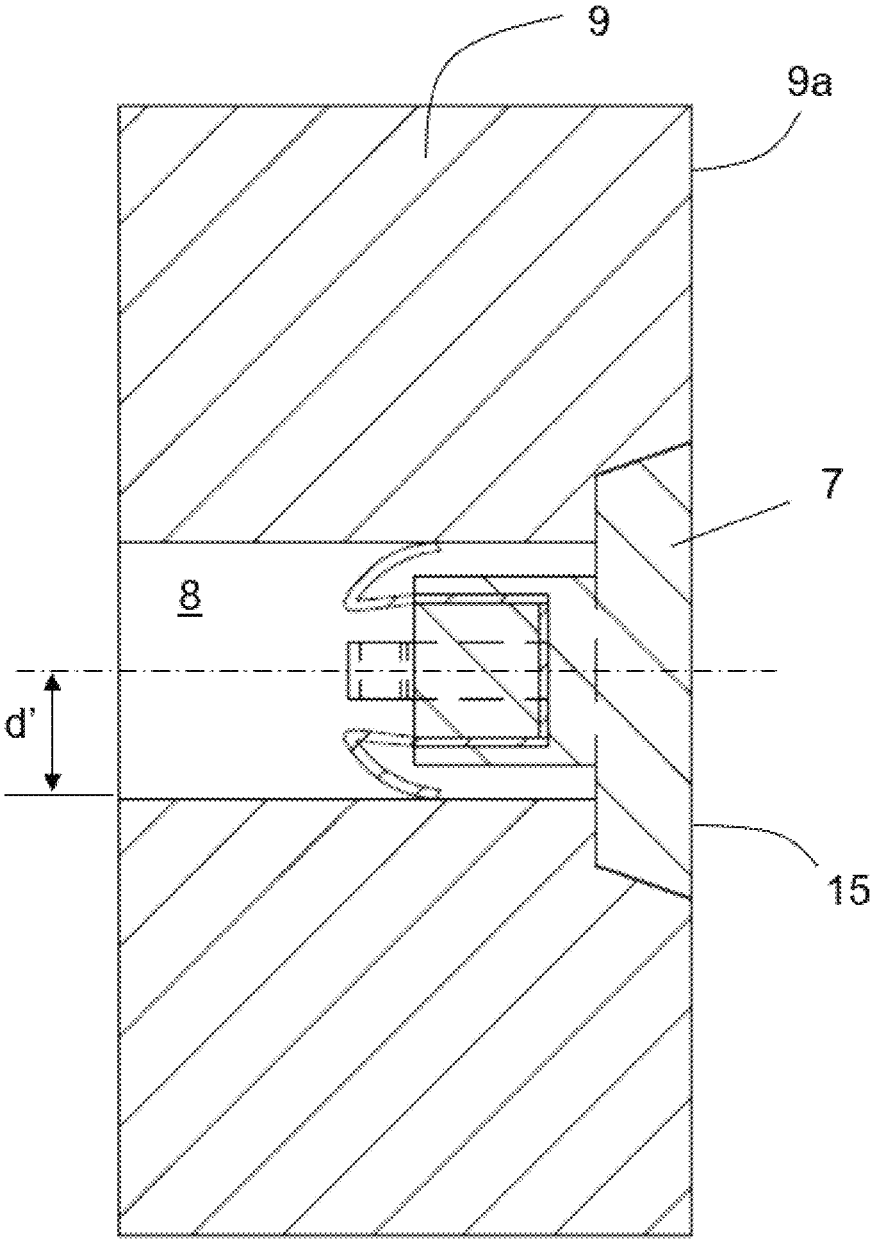
FIG. 11B shows a section view of the plug of FIG. 3A in use, i.e., introduced in the hole to be plugged.

The plug 1 in use, i.e., when the plug 1 is introduced in the hole 8 to be plugged, is aligned with the wall or concrete wall 9, thereby concealing said hole 8, as can be seen in FIG. 11B for example. Holes in concrete walls are unavoidable because most, if not all of said holes, are caused by the manufacturing process of the concrete wall 9 itself.

The plug 1 provides an easy placement of the plug 1 in the hole 8 in the concrete wall 9 to be plugged because it is not necessary to use additional means, such as adhesives, for example, for retaining the plug 1 in place. Furthermore, the securing of said plug 1 is also improved because the hook or hooks of the elastic means 4 provide very good securing whether the hole 8 to be plugged comprises the protective plastic tube of the transverse bolts (securing on plastic material) or does not comprise said tube (securing directly on concrete).

Figure 2A:
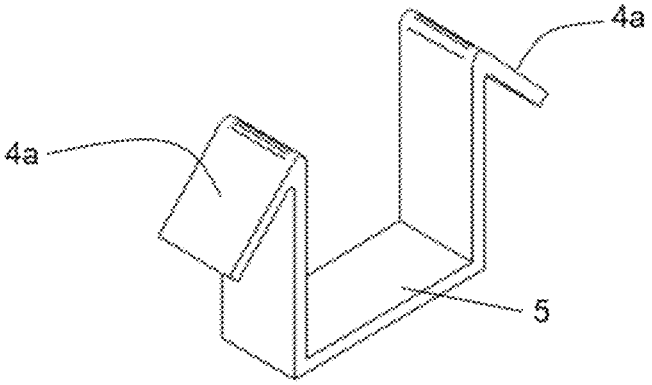
FIG. 2A is a perspective view of a set of two hooks of the elastic retention means attached by a U-shaped retention element.
Figure 2B:
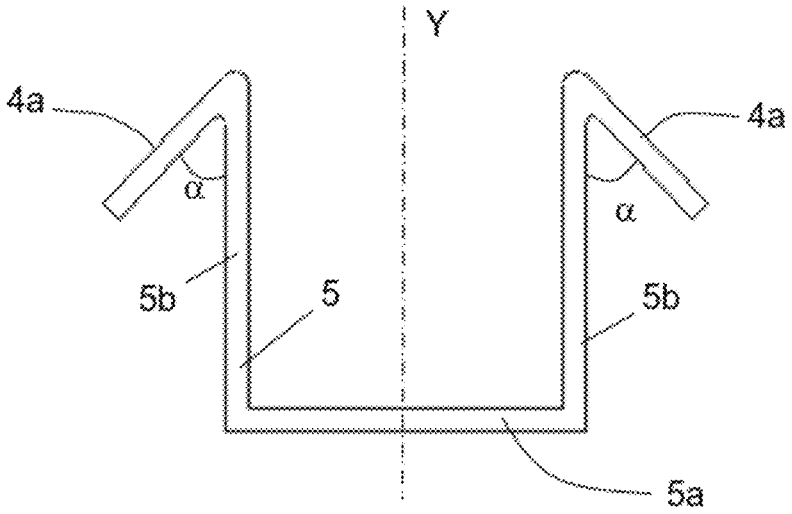
FIG. 2B is an elevational view of the set of hooks of FIG. 2A.

In an embodiment shown in FIGS. 1A and 1B, the retention means 4 comprise a plurality of hooks, preferably four, each hook comprising a retention flange 4*a* forming an acute angle $\alpha$ with respect to a longitudinal axis X of the plug 1, as can be seen in FIG. 1B, or in greater detail in FIG. 2B. As a result of the configuration of these flanges 4*a*, the plug 1 is easily arranged in place because no great effort is required to insert the plug 1 inside the hole 8 to be plugged, but at the same time the flanges 4*a* provide good securing which lasts over time such that additional means, such as adhesive, for example, are not necessary to keep the plug in place.

The free ends of the flanges 4*a* of the retention means 4 are arranged at a distance d from the longitudinal axis X of the plug 1, said distance d being greater than the radius of the hole 8 in the concrete wall 9 to be plugged, such that, in use, with the plug 1 being arranged inside the hole 8 to be plugged, and preferably aligned with the concrete wall 9, the flanges 4*a* are compressed inside the hole 8, as can be seen in FIG. 11B, the free ends of the flanges 4*a* in this case being at a compressed distance d' from the longitudinal axis X of the plug 1, said compressed distance d' being less than the initial distance d. That is, the retention flanges 4*a* are compressed upon entering the hole 8 to be plugged, with the securing force of the plug 1, which force is exerted by the flanges 4*a* against the surface of the hole 8 to be plugged, being thereby increased. The hooks of the retention means 4, independently of the inner surface of the hole 8 to be plugged, exert very good gripping pressure; therefore, independently of whether the hole 8 to be plugged comprises the protective plastic tube of the transverse bolts, necessary in the manufacturing process of the concrete wall 9, or does not comprise said tube, the flanges 4*a* of the hooks of the retention means 4 adapt to the surface of the hole 8 to be plugged, the plug 1 being strongly secured inside the hole 8 to be plugged, regardless of the texture of the surface of said hole 8, of plastic (in the event that the hole comprise the plastic protective tube of the transverse bolt), or of concrete (in the event that it does not comprise said plastic protective tube). In the example of FIG. 11B, the hole 8 to be plugged does not comprise the protective plastic tube; therefore, the hooks of the retention means 4, i.e., the flanges 4*a*, apply pressure directly on the concrete.

If the retention means 4 of the plug 1 comprise a plurality of hooks, these hooks are arranged equidistantly around the longitudinal axis X of the plug 1. To facilitate the manufacture of the plug 1, the retention means 4 comprise a set of at least two hooks arranged equidistantly around the longitudinal axis X of the plug 1, preferably diametrically opposite to one another, and attached to each other by a retention element. Each hook comprises a respective retention flange 4*a*. In the non-limiting example of FIGS. 2A and 2B, the two retention flanges 4*a* are attached to one another by a U-shaped retention element 5. That is, at each end of the U-shaped retention element 5 extends a corresponding hook with a respective retention flange 4*a*, correct securing of the plug 1 inside the hole 8 to be plugged thus being assured. Part of the retention element 5 is embedded in the main body 2, preferably the central part, whereas the retention flanges 4*a* emerge out from the main body 2. In a variant of this embodiment, the retention means 4 comprise two sets of two hooks, each hook comprising a corresponding retention flange 4*a*, both sets being arranged rotated with respect to each other, preferably 90°.

The U-shaped retention element 5 of each set comprises a base 5*a* and two legs 5*b*, each one attached to a corresponding end of said base 5*a*, as can be seen in FIG. 2B, forming a single part. Each leg 5*b* is part of a corresponding hook. In the example of FIG. 2B, the legs 5*b* and the base 5*a* are attached perpendicularly, said legs 5*b* being arranged in this case parallel with the longitudinal axis X of the plug 1. However, the legs 5*b* can form another different angle with the base 5*a*, in which case the flanges 4*a* would continue to form the acute angle α with respect to the longitudinal axis X of the plug 1.

Figure 2C:
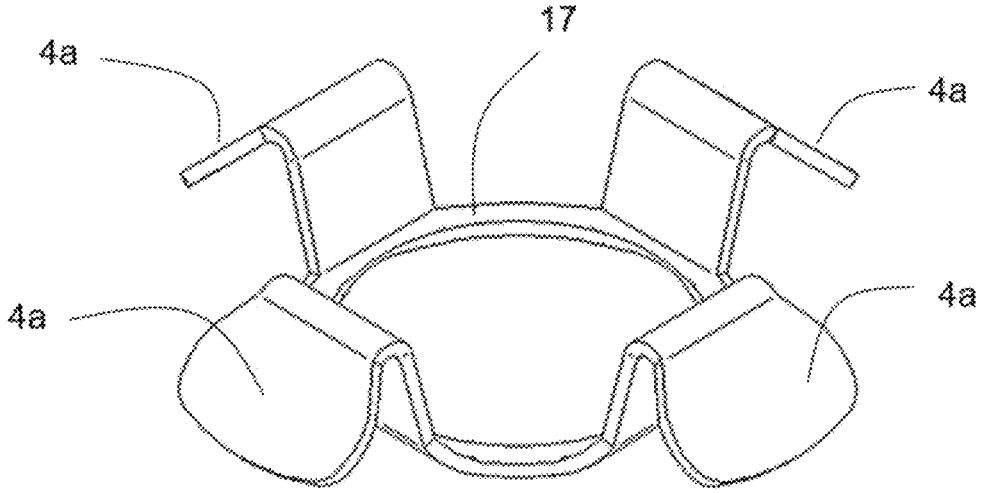
FIG. 2C shows a perspective view of a set of four hooks of the elastic retention means attached by a circular ring retention element.

In the non-limiting example of FIG. 2C however, the hooks of the set of hooks of the retention means are arranged also equidistantly around the longitudinal axis X of the plug 1 but the hooks are attached to one another by a circular retention element 17 which is embedded in the main body 2. The circular retention element 17 may have a disc or ring shape. As shown in FIG. 2C the hooks protrude from the circular ring retention element 17, the corresponding retention flanges 4*a* emerging out of the main body 2.

In a preferred embodiment of this example, the set of hooks of the retention means 4 comprises four hooks, each hook comprising a respective retention flange 4*a*, all hooks being attached to the circular retention element 17 forming two sets of diametrically opposite flanges 4*a*, both sets of flanges 4*a* being disposed rotated with respect to each other, preferably 90°.

The retention flanges 4*a* can form an acute angle α with respect to the longitudinal axis X of the plug, or they can be perpendicular to said longitudinal axis X, as will be described in detail further below.

Figure 3A:
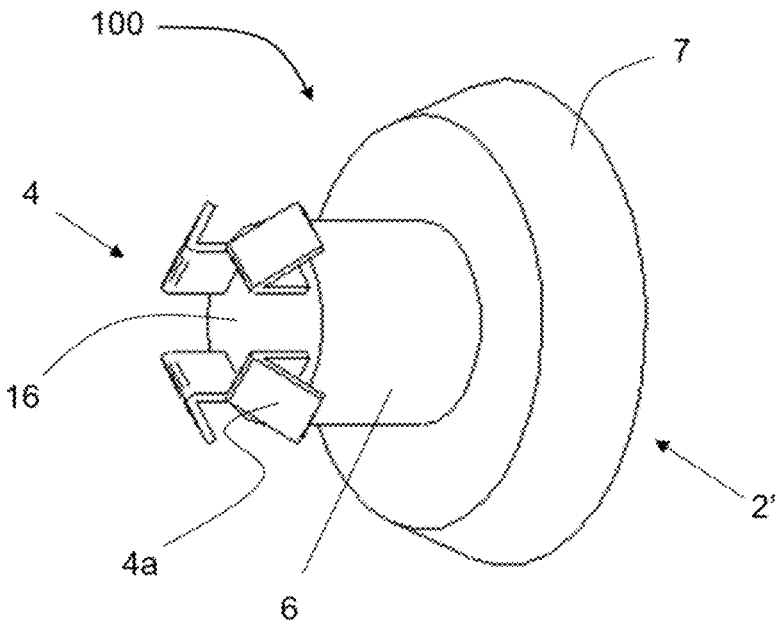
FIG. 3A shows a perspective view of a plug according to another embodiment.
Figure 4A:
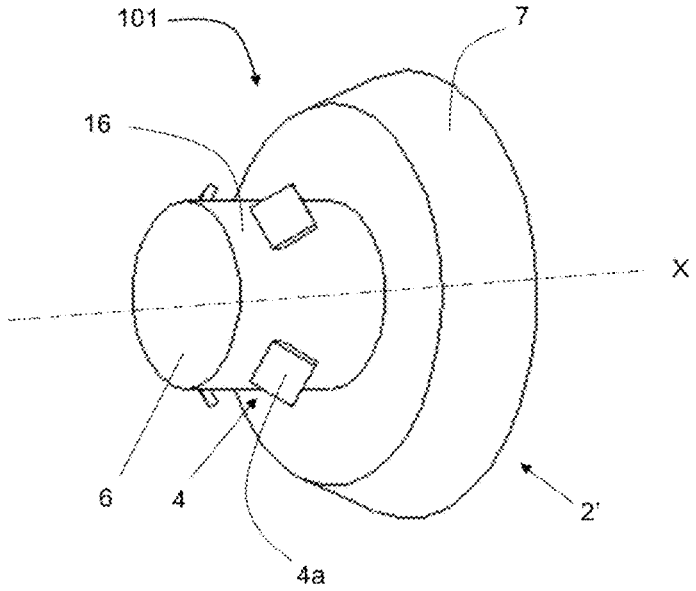
FIG. 4A shows a perspective view of a plug according to another embodiment.
Figure 4B:
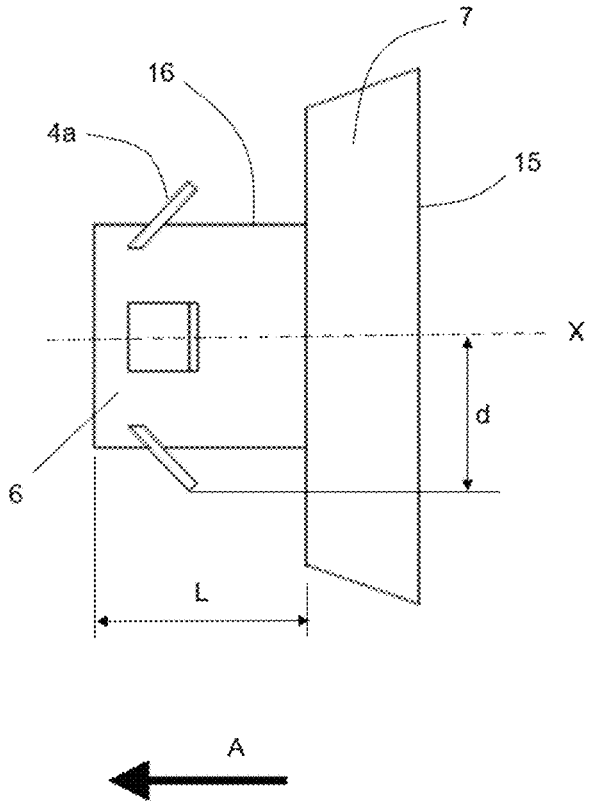
FIG. 4B shows a side view of the plug of FIG. 4A.

The flanges 4*a* of hooks of the plugs of the examples of FIGS. 1A, 3A and 4A can be joined altogether by the circular retention element 17 or they can be joined in sets of two flanges 4*a* with the U-shaped retention elements 5.

In the preferred embodiment, the main body 2 comprises a frustoconical or cylindrical head 6, the main body 2 comprising an active surface 15, in this embodiment being arranged at one end of the head 6, which in use is aligned with the uncovered face 9*a* of the wall or concrete wall 9, thus concealing the corresponding hole 8. In the context of the invention, the uncovered face 9*a* refers to the visible surface of the concrete wall 9. Said active surface 15 is preferably perpendicular to the longitudinal axis X of the plug 1. The main body 2 also comprises an auxiliary surface 16 which in use is arranged inside the hole 8 in the concrete wall 9, the retention means 4 protruding from said auxiliary surface 16.

In one embodiment, the auxiliary surface 16 is facing the active surface 15, the hooks of the retention means 4 protruding axially from the main body 2, i.e., from said auxiliary surface 16 which is the front surface of the head 6, in the insertion direction A, as shown in FIG. 1A. In another embodiment, the auxiliary surface 16 is the lateral surface of the head 6, i.e the generatrix of the frustoconical or conical head 6, the hooks of the retention means 4 protruding directly radially from the main body 2, i.e., perpendicular to the longitudinal axis X, as will be described in detail below. The shape of the head 6 in the example of FIG. 1A is cylindrical, whereas in the examples of FIGS. 1C and 1E it is frustoconical.

Figure 3B:
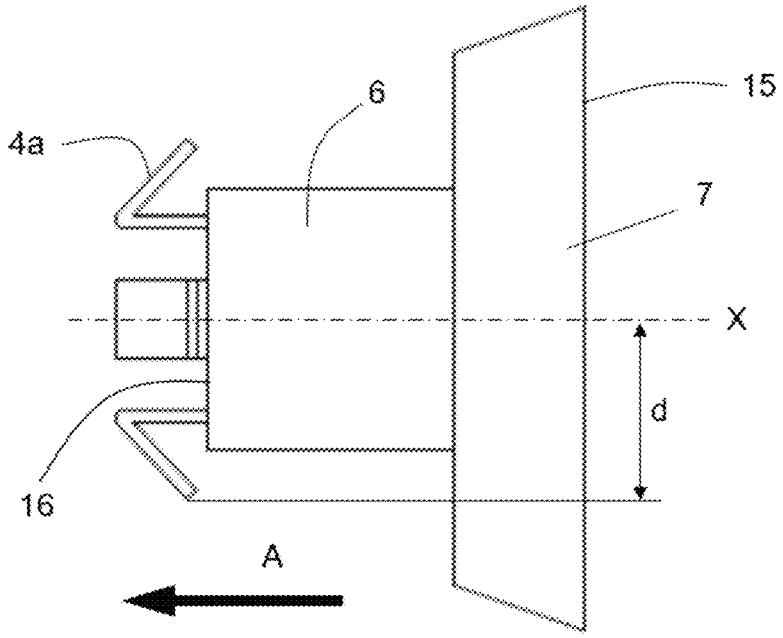
FIG. 3B shows a side view of the plug of FIG. 3A.

In another embodiment, the main body 2' also comprises a frustoconical or cylindrical base 7, the head 6 extending axially from the base 7 in the insertion direction A, as can be seen in FIG. 3B, for example. The head 6 comprises a smaller diameter than the smallest diameter of the base 7. In this embodiment, the active surface 15 of the main body 2', which in use is aligned with the uncovered face 9*a* of the concrete wall 9, is arranged at one end of the base 7. The active surface 15 is also preferably perpendicular to the longitudinal axis X of the plug 1', and hooks of the retention means 4, particularly the retention flanges 4*a*, protrude from the auxiliary surface 16 of the head 6 as described above, namely axially from the front surface of the head 6 or from the lateral surface of the head 6. FIG. 3A, 3B, 4A or 4B show examples of plugs comprising a main body 2' comprising the head 6 and the base 7.

In these embodiments, i.e., in embodiments in which the main body 2' comprises both the head 6 and the base 7, the retention flanges 4*a* can form an acute angle α with respect to the longitudinal axis X of the plug, and the retention means 4 can also comprise at least one set of two hooks arranged diametrically opposite to one another and attached to one another by a U-shaped retention element 5, preferably comprising two sets of two hooks, both sets being arranged rotated with respect to each other, preferably 90°.

These embodiments, i.e., embodiments in which the main body 2' comprises both the head 6 and the base 7, are particularly advantageous when the hole 8 in the concrete wall 9 has a narrow frustoconical opening 8'. As the person skilled in the art knows, the protective kit of the transverse bolt of the manufacturing process of a concrete wall can comprise a central cylindrical segment (cylindrical protective tube made of plastic) to which there is added at each end a frustoconical element made of plastic which is removed once the concrete is set. The hole 8 generated in the concrete wall 9 will therefore have two frustoconical openings 8' (made of concrete) arranged at the ends of the hole 8 between which there is arranged a cylindrical segment 8" (made of plastic if the protective tube has not been removed, or made of concrete if said protective tube has been removed), as can be seen in FIG. 11A. Usually only one of the frustoconical openings 8' of the hole 8, the opening 8' arranged in the exposed face 9*a* of the concrete wall 9, is plugged, such that in the description reference will only be made to a hole 8 in which the opening 8' is arranged in the exposed face 9*a* of the concrete wall 9. However, if both openings are to be plugged, the same will be done at both ends of the hole 8. FIGS. 11A and 11B depict a hole 8 with a frustoconical opening 8' (the second opening being omitted) to better understand the invention. Depending on the shape of the frustoconical opening 8' of the hole 8 to be plugged, it will be appropriate to use one plug (without the base 7) or the other (with the base 7) to assure better securing of the plug. For example, in the event that the frustoconical segment of the opening 8' of the hole 8 is narrow (not very deep), it is advisable to use the plugs 100, 101, 110, 111, 120, 121, 122, 122', 122" or 123 comprising the main body 2' with the base 7 (according to any of its variants). Otherwise, i.e., if the frustoconical segment of the opening 8' of the hole 8 to be plugged is deep enough, both plug 1, 1' or 1" comprising the main body 2 without the base 7 and plugs 100, 101, 110, 111, 120, 121, 122, 122', 122" or 123 which comprising the base 7, could be used.

In these embodiments, i.e., embodiments in which the main body 2' comprises both the head 6 and the base 7, the base 7 can be adjusted to the shape of the frustoconical opening 8' of the hole 8 such that when said base 7 abuts with the bottom of the frustoconical opening 8', the active surface 15 of the main body 2' is aligned with the exposed face 9*a* of the concrete wall 9.

Furthermore, in this embodiment in which the main body 2' comprises the head 6 and the base 7, said head 6 and said base 7 form a single part.

Figure 5A:
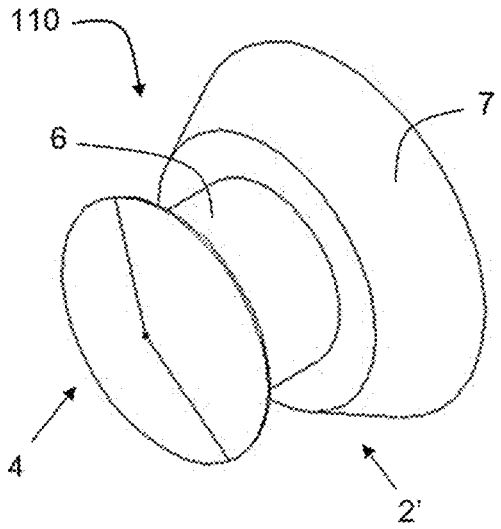
FIG. 5A shows a perspective view of a plug according to another embodiment.
Figure 5B:
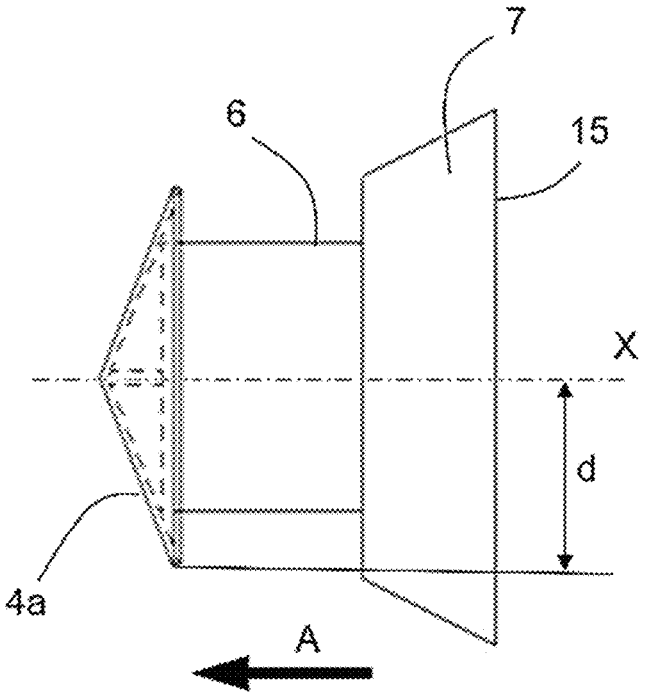
FIG. 5B shows a side view of the plug of FIG. 5A.

FIGS. 5A and 5B show another embodiment of the plug 110, in which the only thing that changes with respect to the described plugs are the elastic retention means 4. In this case, the main body 2' comprises both the head 6 and the base 7 and the retention means 4 comprise a single hook comprising a single conical-shaped retention flange 4*a*, as can be seen for example in FIG. 5C, and a mast 10. The retention flange 4*a* is attached to the mast 10 which is arranged on the geometric axis of the retention flange 4*a*, part of said mast 10 being embedded in the main body 2', such that said mast 10 is arranged parallel to or aligned with the longitudinal axis X, the hook protruding axially from the main body 2' in the insertion direction A. The mast 10 can be a rod or a rod with a helical embedded portion, for example.

Figure 5C:
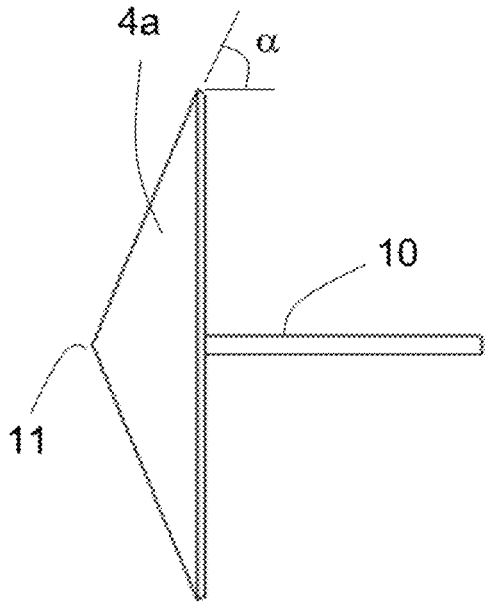
FIG. 5C shows a side view of an embodiment of the elastic retention means of the plug of FIG. 5A.
Figure 5D:
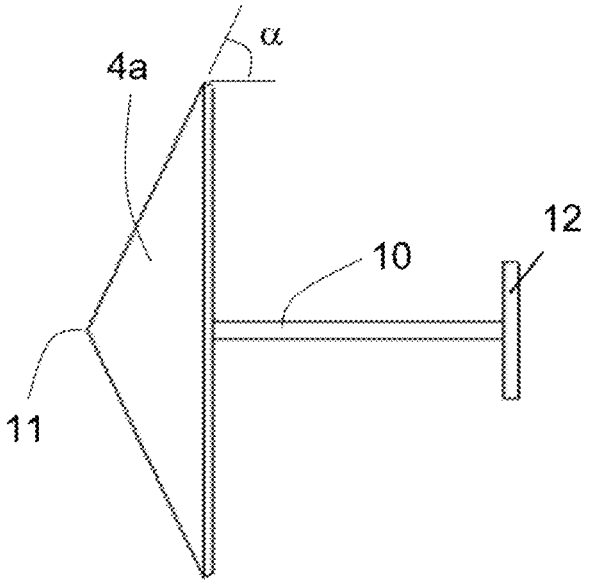
FIG. 5D shows a side view of another embodiment of the elastic retention means of the plug of FIG. 5A.

As can be seen in FIG. 5C, the retention means 4 of this embodiment resemble an open umbrella, the retention flange 4*a* forming an acute angle α with respect to the longitudinal axis X of the plug. For the purpose of improving adherence of the mast 10 in the main body 2', said mast 10 can comprise at the end farthest away from the vertex 11 of the hook a stop 12 which is arranged preferably perpendicular to the mast 10, as can be seen in FIG. 5D, or a helical portion, thus improving the grip between the mast 10 and the main body 2'.

Figure 7A:
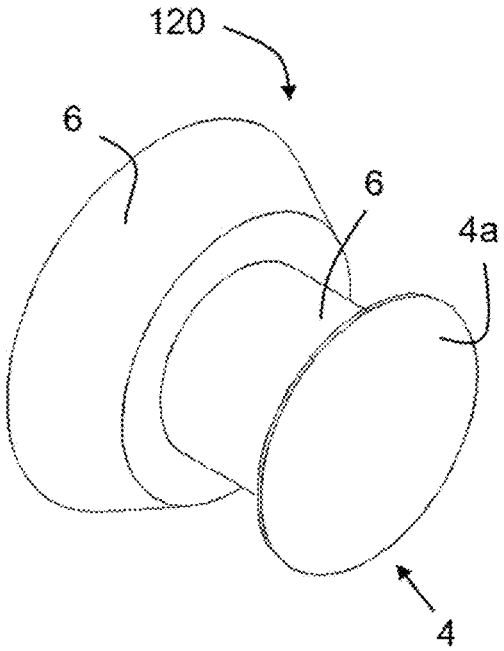
FIG. 7A shows a perspective view of a plug according to another embodiment.
Figure 7B:
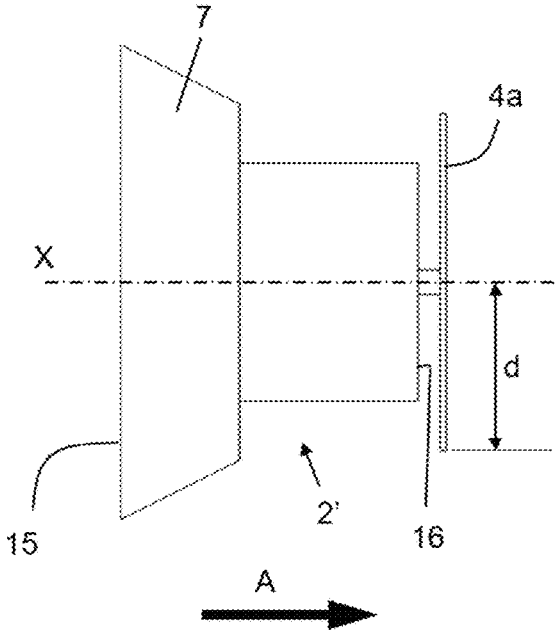
FIG. 7B shows a side view of the plug of FIG. 7A.
Figure 7C:
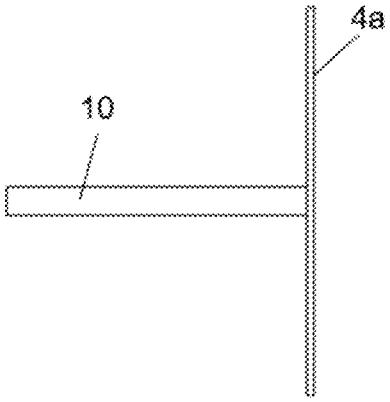
FIG. 7C shows a side view of the elastic retention means of the plug of FIG. 7A.

Another variant of the plug 120 shown in FIGS. 7A, 7B and 7C differs from the plug 110 described above in the shape of the retention means 4. The retention means 4 of this variant also comprise a single hook with a single retention flange 4*a*, but in this case it is circular. The retention flange 4 can be arranged perpendicular to the longitudinal axis X or tilted with respect to said longitudinal axis X. Said retention flange 4*a* is also attached to a mast 10 arranged on its geometric axis, part of said mast 10 being embedded in the main body 2', such that said mast 10 is arranged parallel to or aligned with the longitudinal axis X, the hook of the retention means 4 protruding axially from the main body 2' in the insertion direction A. The mast 10 can be a rod or a rod with a helical embedded portion, as in the example before. When the plug 120 is introduced in the hole 8 to be plugged, the retention flange 4*a* is bent, the retention flange 4*a* being compressed inside the hole 8 to be plugged such that it exerts continuous pressure against the inner surface of the hole 8.

Figure 8A:
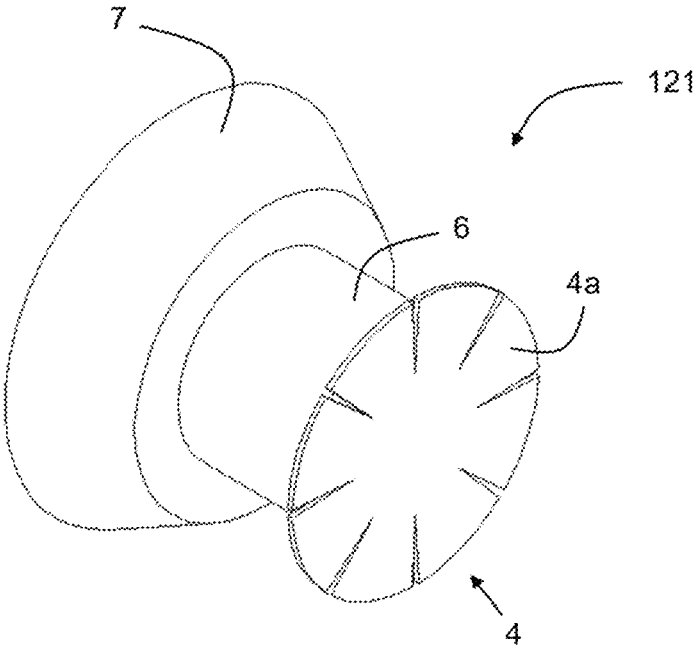
FIG. 8A shows a perspective view of a plug according to another embodiment.
Figure 8B:
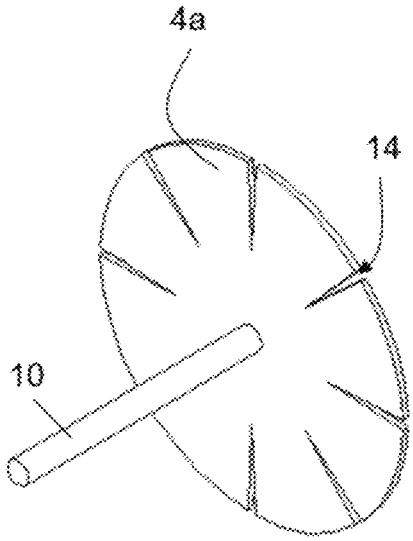
FIG. 8B shows a perspective view of the elastic retention means of the plug of FIG. 8A.
Figure 8C:
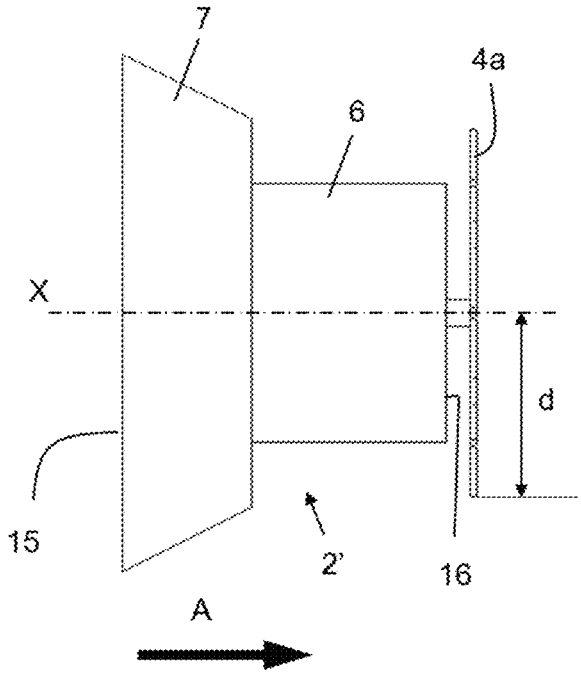
FIG. 8C shows a side view of the plug of FIG. 8A.

To facilitate the bending of the circular retention flange 4*a*, the latter can optionally comprise at least one notch 14 arranged at the distal end of the retention flange 4*a*, said notch 14 preferably extending in a radial direction of said circular retention flange 4*a*. In the example of the plug 121 of FIGS. 8A, 8B and 8C, the circular retention flange 4*a* comprises a plurality of radial notches 14 distributed uniformly along the peripheral circumference of the retention flange 4*a*.

Figure 6A:
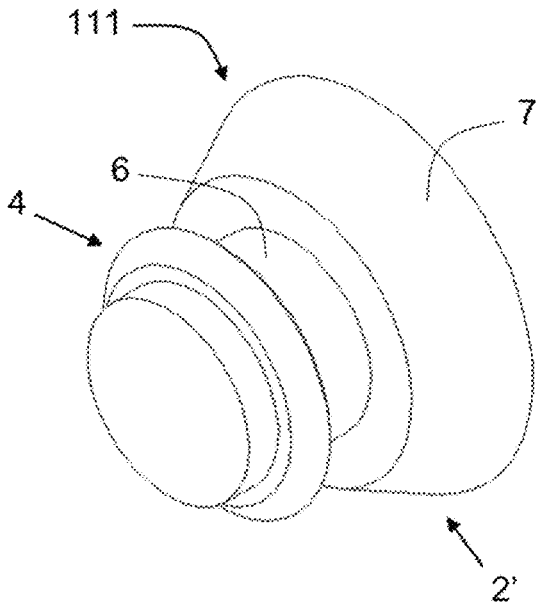
FIG. 6A shows a perspective view of a plug according to another embodiment.
Figure 6B:
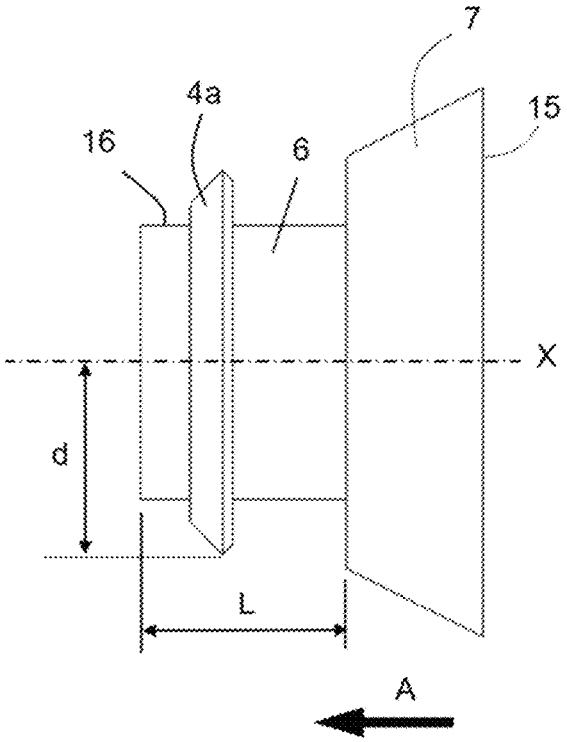
FIG. 6B shows a side view of the plug of FIG. 6A.

Another variant of the plug 111, shown in FIGS. 6A and 6B, differs from the plugs 110, 120 and 121 described above in the shape of the retention means 4. The retention means 4 of this variant also comprise a single hook comprising a single retention flange 4*a*, but in this case, in the form of a frustoconical ring, such that it forms a perimetral skirt. The hook also comprises a support 13 in the form of a circular ring or a circular disc shape. The end having a smaller dimension of the retention flange 4*a* is attached to the support 13, at least part of said support 13 being embedded in the main body 2'. Said support 13 is arranged transverse to the longitudinal axis X such that the hook protrude radially from the main body 2', preferably from the head 6 of the main body 2', as can be seen in FIG. 6B. In a variant, the embedded portion of the hook is fixed to a rod or a helical bolt, not shown in the drawings, said rod or helical bolt being also embedded in the main body 2'. The rod or helical bolt embedded in the main body 2' is preferably arranged in the longitudinal direction of the main body 2'.

Figure 6C:
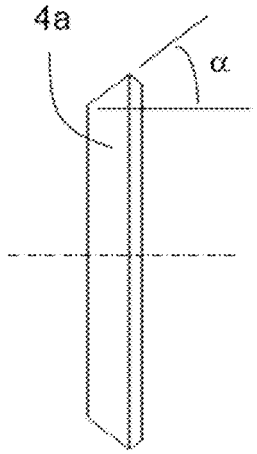
FIG. 6C shows a side view of the elastic retention means of the plug of FIG. 6A.
Figure 6D:
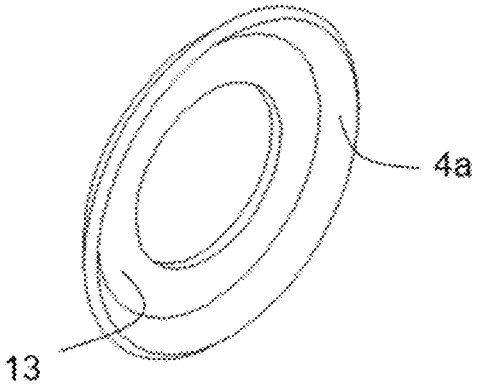
FIG. 6D shows a perspective view of the elastic retention means of the plug of FIG. 6A.

As shown in FIG. 6B or 6C, the retention flange 4*a* forms an acute angle α with respect to the longitudinal axis X of the plug. Furthermore, the free end of the retention flange 4*a* is still arranged at distance d from the longitudinal axis X of the plug 111, as can be seen in FIG. 6B, said distance d being greater than the radius of the hole 8 in the concrete wall 9 to be plugged.

Figure 9B:
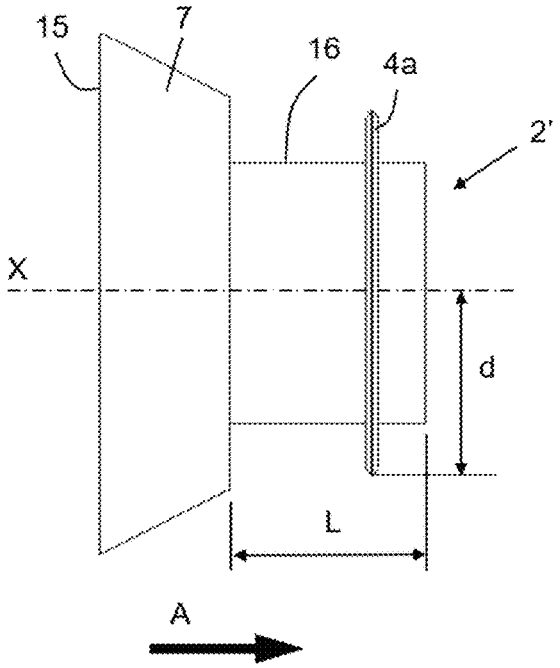
FIG. 9B shows a side view of the plug of FIG. 9A.
Figure 9A:
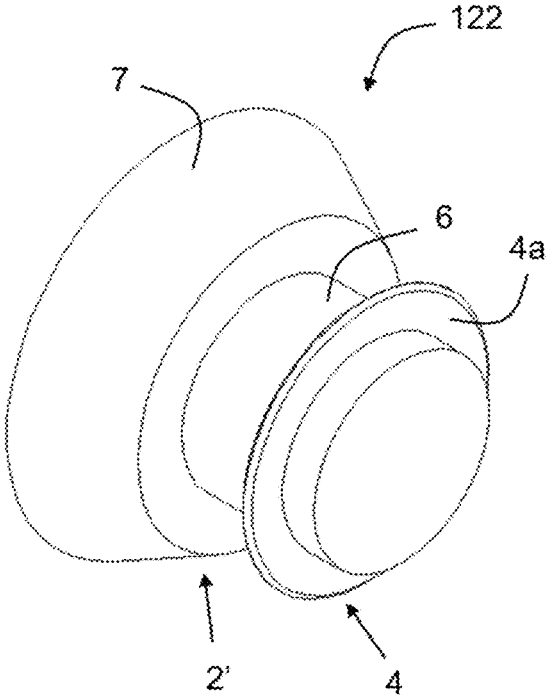
FIG. 9A shows a perspective view of a plug according to another embodiment.
Figure 9C:
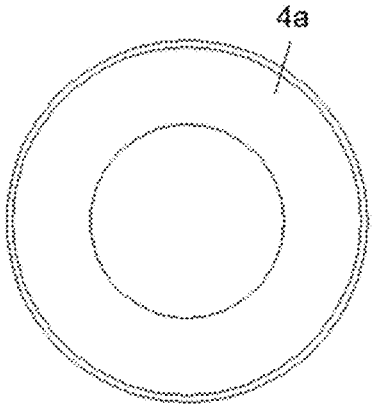
FIG. 9C shows a front view of the elastic retention means of the plug of FIG. 9A.
Figure 9D:
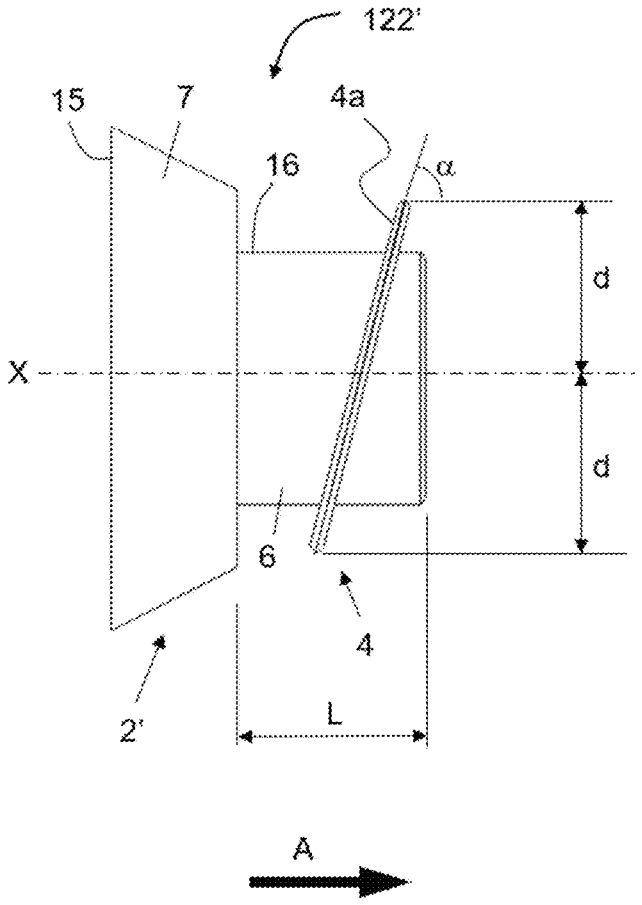
FIG. 9D shows a side view of a variant of the plug of FIG. 9A, wherein the hook of the retention means is arranged inclined with respect to the longitudinal axis X.

Another variant of the plug 122, shown in FIGS. 9A and 9B and 9C, differs from the plug 111 described above in the shape of the retention means 4. The retention means 4 of this variant also comprise a single hook with a single retention flange 4*a*, but in this case in the form of an annulus, as can be seen in FIG. 9C, or a disc, the annulus or the disc protruding radially from the main body 2' of the plug 122, preferably from the head 6, such that the retention flange 4*a* is arranged perpendicular to the longitudinal axis X of the plug 122. The free end of the retention flange 4*a* is still arranged at distance d from the longitudinal axis X of the plug 122, as can be seen in FIG. 9B, said distance d being greater than the radius of the hole 8 in the concrete wall 9 to be plugged. In a variant shown in FIG. 9D, the annulus or disc of the retention means 4 of the plug 122' is arranged tilted with respect to said longitudinal axis X instead of being arranged perpendicular to the longitudinal axis X.

In this embodiment, it is not necessary for the retention means 4 to comprise an additional support to allow the attachment to the main body 2' because part of the annulus, preferably the part having a smaller diameter, or disc is embedded in the main body 2', as can be seen in FIG. 9A. When the plug 122 is introduced in the hole 8 to be plugged, the retention flange 4*a* is bent, the retention flange 4*a* being compressed inside the hole 8 to be plugged, such that it exerts continuous pressure against the inner surface of the hole 8.

Figure 10A:
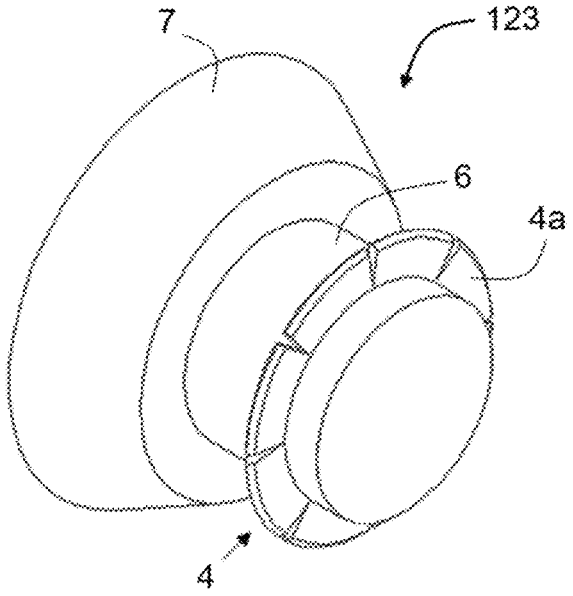
FIG. 10A shows a perspective view of a plug according to another embodiment.
Figure 10B:
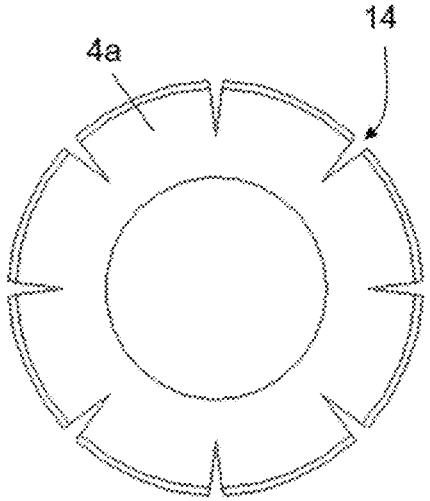
FIG. 10B shows a front view of the elastic retention means of the plug of FIG. 10A.
Figure 10C:
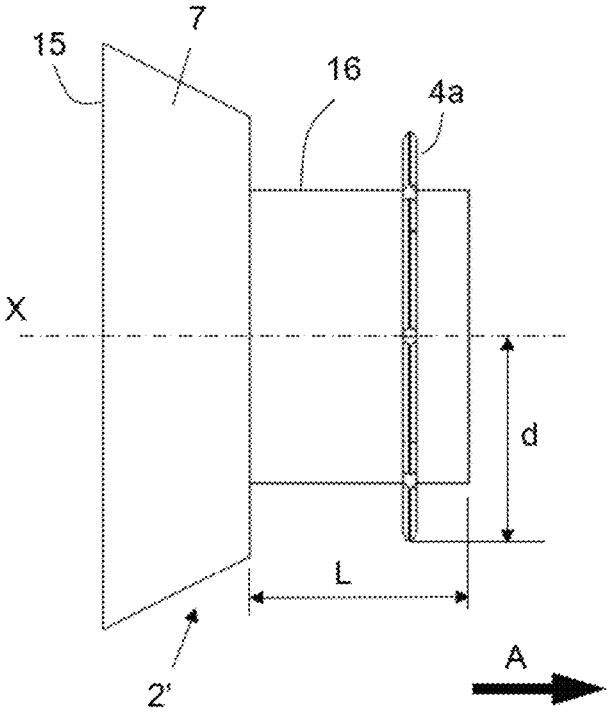
FIG. 10C shows a side view of the plug of FIG. 10A.

To facilitate the bending of the retention flange 4*a* in the form of an annulus, it can optionally also comprise at least one notch 14 arranged at the distal end of the retention flange 4*a*. In the example of the plug 123 of FIGS. 10A and 10B, the retention flange 4*a* comprises a plurality of radial notches 14 distributed uniformly along the peripheral circumference of the retention flange 4*a*. The notches 14 extend radially, as can be seen in FIG. 10B.

In the embodiments of FIGS. 1C to 1F, the main body 2 of the plugs 1' and 1" does not comprise the base 7, and the head 6, which is frustoconical in this case, is longer than the head 6 of the plug 1 of FIG. 1A (which does comprise the base 7). These plugs 1' and 1" are suitable for being used when the hole 8 generated in the concrete wall 9 is conical or frustoconical along the entire length thereof.

Unlike the embodiment of the plug 1 of FIG. 1A (which does not comprise the base 7) in which the retention means 4 protrude axially from the main body 2, in the plugs 1' and 1" of FIGS. 1C to 1F the retention means 4 protrude from the main body 2 according to a direction perpendicular to the longitudinal axis X.

Figure 1C:
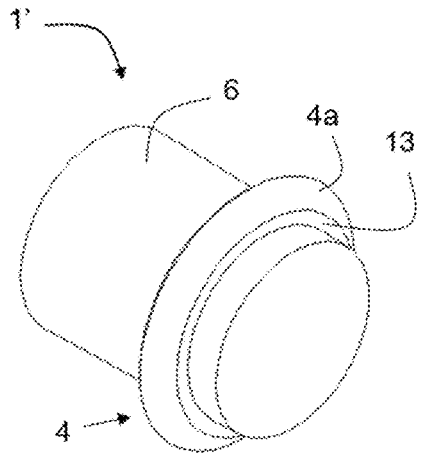
FIG. 1C shows a perspective view of a plug according to another embodiment.
Figure 1D:
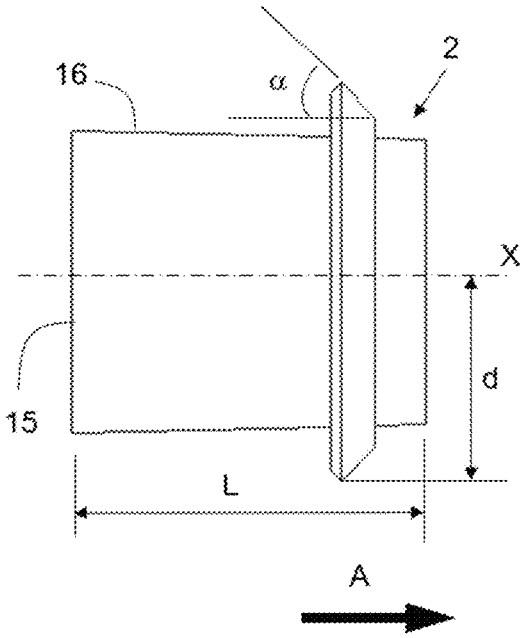
FIG. 1D shows a side view of the plug of FIG. 1C.

The retention means 4 of the plug 1' of the embodiment of FIGS. 1C and 1D comprise a single hook comprising a single retention flange 4*a* in the form of a frustoconical ring, such that it forms a perimetral skirt, as described for the plug 111 of FIG. 6A. The hook also comprises a support 13 in the form of a circular ring or a circular disc. The end having a smaller dimension of the retention flange 4*a* is attached to the support 13, at least part of said support 13 being embedded in the main body 2'. The support 13 is arranged transverse to the longitudinal axis X, the retention means 4 protruding from the main body 2 according to a direction perpendicular to the longitudinal axis X, as can be seen in FIG. 1D. In this case, the retention flange 4*a* forms an acute angle α with respect to the longitudinal axis X of the plug and the free end of the retention flange 4*a* is still arranged at distance d from the longitudinal axis X of the plug 1', said distance d being greater than the radius of the hole 8 in the concrete wall 9 to be plugged.

Optionally, the embedded portion of the support 13 of the hook can be fixed to a rod or a helical bolt, not shown in the drawings, said rod or helical bolt being also embedded in the main body 2. The rod or helical bolt embedded in the main body 2 is preferably arranged in the longitudinal direction of the main body 2.

Figure 1F:
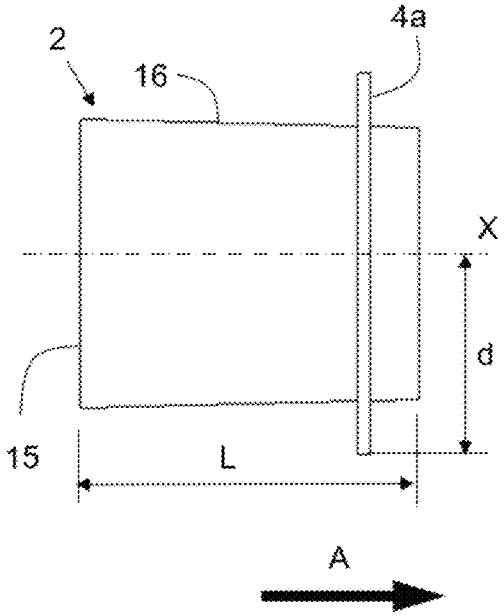
FIG. 1F shows a side view of the plug of FIG. 1E.
Figure 1E:
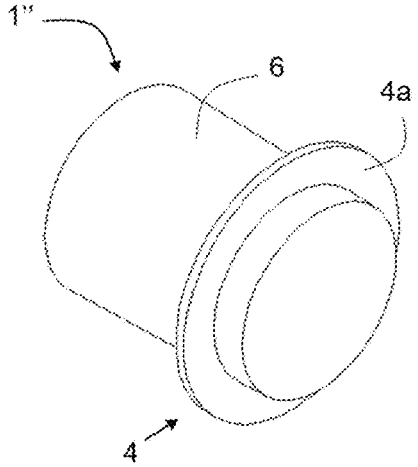
FIG. 1E shows a perspective view of a plug according to another embodiment.

The retention means 4 of the plug 1" of the embodiment of FIGS. 1E and 1F differs from the plug 1' described above in the shape of the retention means 4. As in the case of the plug 122 of FIG. 9A, the retention means also comprise a single hook comprising a retention flange 4*a*, but in this case in the form of an annulus, as can be seen in FIG. 1F, or a disc, part of the annulus or the disc being embedded in the main body 2 and part of the annulus or disc protruding from the head 6 of the main body 2 according to a direction perpendicular to the longitudinal axis X of the plug 1", the retention flange 4*a* being arranged perpendicular to the longitudinal axis X of the plug 1" in this case. The free end of the retention flange 4*a* is still arranged at distance d from the longitudinal axis X of the plug 1", as can be seen in FIG. 1F, said distance d being greater than the radius of the hole 8 in the concrete wall 9 to be plugged. Optionally, the embedded portion of the annulus or disc of the hook can be fixed to a rod or a helical bolt, not shown in the drawings, said rod or helical bolt being also embedded in the main body 2. The rod or helical bolt embedded in the main body 2 is preferably arranged in the longitudinal direction of the main body 2.

In a variant not shown in the drawings, the annulus or disc is arranged inclined with respect to said longitudinal axis X instead of being arranged perpendicular to the longitudinal axis X. When the plug 1" is introduced in the hole 8 to be plugged, the retention flange 4*a* is bent, the retention flange 4*a* being compressed inside the hole 8 to be plugged, such that it exerts continuous pressure against the inner surface of the hole 8.

To facilitate the bending of the retention flange 4*a* in the form of an annulus or a disc, it can optionally also comprise the notches 14 described above.

Optionally, in other variants of the embodiments comprising a hook comprising a single retention flange 4*a* protruding from the head 6 according to a direction perpendicular to the longitudinal axis X, whether or not they comprise the notches 14, or are arranged perpendicular or tilted with respect to said longitudinal axis X, the retention means 4 can comprise more than one hook, the retention flanges 4*a* of each hook being spaced apart from one another according to the direction of the longitudinal axis X. The free ends of the retention flanges 4*a* of the plurality of hooks can be arranged at the same distance d with respect to the longitudinal axis X, or said distance d can be decreased as the retention flanges 4*a* approach the free end of the head 6 of the corresponding plug according to the insertion direction A. An example of these variants is shown in FIG. 9E.

Figure 9E:
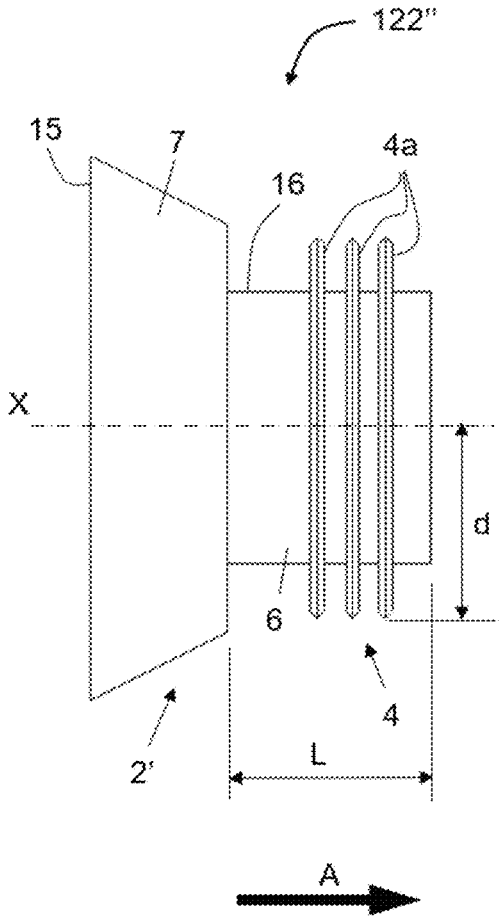
FIG. 9E shows a side view of another variant of the plug of FIG. 9*a*, wherein the retention means comprise a plurality of hooks.

In FIG. 9E, which corresponds with a plug 122" of the type having a main body 2' which comprises both the head 6 and the base 7, the retention means 4 comprise three hooks, each hook comprising a retention flange 4*a* in the form of an annulus or disc shape, and in this case, protruding radially from the head 6. The retention flanges 4*a* are arranged parallel and spaced apart from one another according to the direction of the longitudinal axis X. In this example, the free ends of all the retention flanges 4*a* are arranged at the same distance d with respect to the longitudinal axis X.

The head 6 of the main body comprises a length L, such that the hook or hooks protruding from the lateral surface of the head 6 according to any of the embodiments described, are placed axially within said length L. With this configuration the plug is more robust and reliable since a void core in the retention means 4 is avoided, i.e. cantilever hooks are avoided, which can weaken the plug over time.

FIG. 11B shows a section view of the plug 100 of the embodiment of FIGS. 3A and 3B (embodiment in which the main body 2' comprises the base 7) introduced in the hole 8 to be plugged. As shown in said figure, the retention flanges 4*a* are compressed and exert continuous pressure against the inner surface of the hole 8 (in this case, against the inner surface of the cylindrical segment 8"), which pressure lasts over time. The shape of the retention flanges 4*a* before and after introducing the plug 100 in the hole 8 to be plugged can be seen in FIGS. 11A and 11B. As shown in FIG. 11B, the base 7 (according to any of its variants) is arranged inside the cylindrical segment 8" of the hole 8 in the concrete wall 9. In this case, the distance d of the retention flanges 4*a* with respect to the longitudinal axis X of the plug 100 before introducing the plug 100 in the hole 8 is greater than the radius of the cylindrical segment 8" of the hole 8 in the concrete wall 9. If the plug is retained in the frustoconical opening 8' of the hole 8 by the retention flanges 4*a*, for example of the plug 1 of the embodiment without the base 7, then the distance d of the retention flanges 4*a* with respect to the longitudinal axis X of the plug 1 before introducing said plug 1 in the hole 8 is greater than the radius of an annular portion of the frustoconical opening 8', which portion corresponds with the position of the plug 1 in which it is aligned with the concrete wall 9.

According to any of the described embodiments, the elastic means 4 of the plug and the main body 2 or 2' are made of different materials, the elastic means 4 being made of a first material and the main body 2 or 2' of a second material. The first material is a plastic or metallic material, preferably stainless steel, and the second material is fiber cement, preferably similar in texture and color to the material of the concrete wall 9 containing the hole 8 to be plugged.

Embodiments are disclosed in the following clauses.

Clause 1. Plug for closing a hole in a concrete wall, comprising a main body (2; 2') and elastic retention means (4), the retention means (4) comprise at least one hook partially embedded in the main body (2; 2') and partially projecting from the main body (2; 2'), the at least one hook being configured for cooperating with the hole (8) of the concrete wall (9) for retaining the plug (1; 1'; 1"; 100; 101; 110; 111; 120; 121; 122; 122'; 122"; 123) in said hole (8).

Clause 2. Plug according to clause 1, wherein the main body (2) comprises a cylindrical or frustoconical head (6) and the at least one hook directly protrudes from the lateral surface of said head (6).

Clause 3. Plug according to clause 2, wherein the head (6) of the main body (2) comprises a length (L), the at least one hook being placed within said length (L).

Clause 4. Plug according to any of clauses 1 to 3, wherein the at least one hook is arranged perpendicular or tilted to a longitudinal axis (X) of the main body (2; 2').

Clause 5. Plug according to clause 1, wherein the main body (2) comprises a cylindrical or frustoconical head (6) and the at least one hook protrudes axially from a front surface of said head (6).

Clause 6. Plug according to any of clauses 2 to 5, wherein the main body (2') further comprises a base (7), the head (6) of the main body (2') extending axially from said base (7), the head (6) having a smaller diameter than the base (7), the head (6) and the base (7) preferably forming a single part.

Clause 7. Plug according to any of the preceding clauses, wherein the hook comprises a retention flange (4*a*), the free end of the flange (4*a*) being at a distance (d) from a longitudinal axis (X) of the plug (1; 1'; 1"; 100; 101; 110; 111; 120; 121; 122; 122'; 122"; 123), said distance (d) being greater than the radius of the hole (8) of the concrete wall (9) to be plugged, such that, in use, with the plug (1; 1'; 1"; 100; 101; 110; 111; 120; 121; 122; 122'; 122"; 123) being arranged inside the hole (8) to be plugged, the flange (4*a*) is compressed inside the hole (8).

Clause 8. Plug according to clause 7, wherein the retention means (4) comprise a hook comprising a conical or circular retention flange (4*a*) and a mast (10), preferably in the form of a rod or a helical bolt, the retention flange (4*a*) being attached to said mast (10) and at least part of said mast (10) being embedded in the main body (2; 2').

Clause 9. Plug according to clause 7, wherein the retention means (4) comprise a hook comprising a retention flange (4*a*) in the form of a frustoconical ring and a support (13), the end having a smaller dimension of the frustoconical ring being attached to the support (13), said support (13) being a circular ring or a circular disc, at least part of said support (13) being embedded in the main body (2; 2').

Clause 10. Plug according to clause 7, wherein the retention means (4) comprise a hook comprising a retention flange (4*a*) in the form of an annulus or a disc, part of the annulus or the disc being embedded in the main body (2; 2').

Clause 11. Plug according to clause 9 or clause 10, wherein the embedded portion of the hook is fixed to a rod or a helical bolt, said rod or helical bolt being also embedded in the main body (2; 2').

Clause 12. Plug according to any of clauses 9 to 11, wherein the retention means (4) comprise a plurality of hooks, the retention flanges (4*a*) of each hook being spaced apart according to the longitudinal axis (X) direction, the distance (d) from each flange (4*a*) preferably being decreased according to an insertion direction (A) of the plug (122") wherein said plug (122") is brought closer to the hole 8 to be plugged.

Clause 13. Plug according to any of clauses 7 to 12, wherein the retention flange (4*a*) comprises at least one notch (14) arranged at the distal end of the retention flange (4*a*).

Clause 14. Plug according to clause 7, wherein the retention means (4) comprise a set of at least two hooks arranged equidistant around the main body (2; 2'), each hook comprising a respective retention flange (4*a*), the hooks being attached to one another by a retention element (5, 17).

Clause 15. Plug according to clause 14, wherein the retention flanges (4*a*) of the corresponding hooks are attached to one another by a U-shaped retention element (5), part of said retention element (5), preferably the central part, being embedded in the main body (2; 2') while the retention flanges (4*a*) emerge out of the main body (2; 2').

Clause 16. Plug according to clause 15, comprising two sets of two retention flanges (4*a*) arranged diametrically opposite to one another, both sets being arranged rotated with respect to each other, preferably 90°.

Clause 17. Plug according to clause 14, wherein the set of hooks are attached to one another by a circular retention element (17), preferably having a disc o ring shape, the circular retention element (17) being embedded in the main body (2; 2').

Clause 18. Plug according to clause 17, wherein hooks protrude from the circular retention element (17), the respective retention flanges (4*a*) emerging out of the main body (2; 2').

Clause 19. Plug according to clause 17 or 18, wherein the set of hooks of the retention means (4) comprises four hooks, each hook comprising a respective retention flange (4*a*), all hooks being attached to the circular retention element (17) forming two sets of diametrically opposite flanges (4*a*), both sets of flanges (4*a*) being disposed rotated with respect to each other, preferably 90°.

Clause 20. Plug according to any of clauses 7 to 19, wherein each retention flange (4*a*) forms an acute angle ($\alpha$) with respect to the longitudinal axis (X) of the plug (1; 1'; 100; 101; 110; 111; 122').

Clause 21. Plug according to any of the preceding clauses, wherein the retention means (4) are made of a first material, preferably a plastic or metallic material, such as stainless steel, for example, and the main body (2; 2') is made of a second material, preferably fiber cement, said fiber cement preferably being similar in texture and color to the material of the concrete wall (9) containing the hole (8) to be plugged.

What is claimed is:

1. A plug for closing a hole in a concrete wall, the plug comprising:

a main body;

a retention element comprising a base and first and second legs that each extends from the base in a direction of insertion of the plug, at least a portion of the base being embedded in the main body;

first and second retention flanges that respectively extend from the first and second legs, the first and second retention flanges respectively forming first and second acute angles with the first and second leg, each of the first and second retention flanges have a free end that is located a distance from a longitudinal axis of the plug, the distance being greater than a radius of the hole such that, in use, with the plug being arranged inside the hole, the first and second retention flanges are compressed inside the hole.

2. The plug according to claim 1, wherein the retention element is U-shaped.

3. The plug according to claim 1, wherein the base is circular.

4. The plug according to claim 1, wherein the first and second legs of the retention element are arranged symmetrical about the longitudinal axis of the plug.

5. The plug according to claim 1, wherein each of the first and second legs of the retention element is arranged parallel to the longitudinal axis of the plug.

6. The plug according to claim 1, wherein a portion of each of the first and second legs is also embedded in the main body.

7. The plug according to claim 1, wherein the retention element is made of a first material and the main body is made of a second material different than the first material.

8. The plug according to claim 7, wherein the first material is a plastic or a metal and the second material is fiber cement.

9. The plug according to claim 1, wherein the base, first and second legs and first and second retention flanges are made from a single piece of material.

10. The plug according to claim 1, wherein an entirety of the base is embedded in the main body.

11. A plug for closing a hole in a concrete wall, the plug comprising:

a main body;

a retention element comprising a base and first, second, third and fourth legs that each extends from the base in a direction of insertion of the plug, at least a portion of the base being embedded in the main body;

first, second, third and fourth retention flanges that respectively extend from the first, second, third and fourth legs, the first, second, third and fourth retention flanges respectively forming first, second, third and fourth acute angles with the first, second, third and fourth leg, each of the first, second, third and fourth retention flanges have a free end that is located a distance from a longitudinal axis of the plug, the distance being greater than a radius of the hole such that, in use, with the plug being arranged inside the hole, the first, second, third and fourth retention flanges are compressed inside the hole.

12. The plug according to claim 11, wherein the base is circular.

13. The plug according to claim 11, wherein the retention element comprises a U-shape member.

14. The plug according to claim 11, wherein the first, second, third and fourth legs of the retention element are arranged symmetrical about the longitudinal axis of the plug.

15. The plug according to claim 11, wherein each of the first, second, third and fourth legs of the retention element is arranged parallel to the longitudinal axis of the plug.

16. The plug according to claim 11, wherein a portion of each of the first, second, third and fourth legs is also embedded in the main body.

17. The plug according to claim 11, wherein the retention element is made of a first material and the main body is made of a second material different than the first material.

18. The plug according to claim 17, wherein the first material is a plastic or a metal and the second material is fiber cement.

19. The plug according to claim 11, wherein the base, first, second, third and fourth legs and first, second, third and fourth retention flanges are made from a single piece of material.

20. The plug according to claim 1, wherein an entirety of the base is embedded in the main body.

* * * * *